US008567617B1

(12) United States Patent
Tapager

(10) Patent No.: US 8,567,617 B1
(45) Date of Patent: Oct. 29, 2013

(54) WINE GLASS AND BOTTLE HOLDER SUPPORT SYSTEM

(76) Inventor: John T. Tapager, Austin, MN (US)

( * ) Notice: Subject to any disclaimer, the term of this patent is extended or adjusted under 35 U.S.C. 154(b) by 175 days.

(21) Appl. No.: 13/162,862

(22) Filed: Jun. 17, 2011

Related U.S. Application Data

(63) Continuation-in-part of application No. 12/027,681, filed on Feb. 7, 2008, now Pat. No. 7,984,813.

(60) Provisional application No. 60/892,487, filed on Mar. 1, 2007.

(51) Int. Cl.
*A47B 73/00* (2006.01)
*A47F 7/28* (2006.01)
*A47G 23/02* (2006.01)

(52) U.S. Cl.
USPC ..... 211/74; 211/85.18; 211/60.1

(58) Field of Classification Search
USPC ..... 211/85.18, 74, 181.1, 85.21, 85.23, 211/71.01, 85.29, 41.11, 85.4, 60.1, 196, 211/205, 133.4, 75, 113, 119; 220/743, 220/737, 487, 495, 494; D7/701, 637, D7/704–708, 600.1; 248/175, 311.3, 157, 248/156, 163.1, 558, 176.1, 177.1
See application file for complete search history.

(56) References Cited

U.S. PATENT DOCUMENTS

| | | | | |
|---|---|---|---|---|
| 1,112,558 | A | | 10/1914 | Red |
| 1,631,725 | A | | 6/1927 | Halvorsen |
| 1,897,905 | A | | 2/1933 | Johnson |
| 2,456,535 | A | | 12/1948 | Rundell |
| D152,826 | S | | 2/1949 | Raysik |
| D165,303 | S | | 11/1951 | Rogers |
| D166,410 | S | | 4/1952 | Press |
| D228,858 | S | | 10/1973 | Wagschal |
| D230,242 | S | | 2/1974 | Bentley |
| 4,093,076 | A | | 6/1978 | Newton |
| 4,428,484 | A | | 1/1984 | Rattay |
| D272,699 | S | | 2/1984 | Godfrey |
| 4,546,883 | A | | 10/1985 | Youngdale |
| D282,701 | S | | 2/1986 | Tomlin |
| 4,836,392 | A | | 6/1989 | Constantino |
| 4,836,476 | A | * | 6/1989 | Wolf ..... 248/146 |
| D313,132 | S | | 12/1990 | Masacek |
| D331,174 | S | | 11/1992 | Polski |
| 5,180,066 | A | | 1/1993 | McArdle |
| 5,248,048 | A | | 9/1993 | Dore |
| D346,095 | S | | 4/1994 | Gower |
| 5,624,043 | A | | 4/1997 | Baptista |
| 5,711,436 | A | | 1/1998 | Moeller |
| D392,163 | S | | 3/1998 | Jenkinson |
| 5,740,928 | A | | 4/1998 | Dale |

(Continued)

*Primary Examiner* — Jennifer E Novosad
(74) *Attorney, Agent, or Firm* — Jason L. Gilbert

(57) ABSTRACT

A wine glass and bottle holder support system for displaying, holding and transporting a wine bottle and accompanying glasses in a variety of configurations through the use of different types of attachments. The wine glass and bottle holder support system generally includes a lower opening, wherein the lower opening and the upper opening are substantially concentric and including at least one support member connecting the upper support structure to the lower support structure, wherein the support member includes an upper end and a lower end. An attachment member extends from the lower support structure to which various attachments may be secured for allowing support of the wine bottle and glasses in various locations which may not include a steady surface such as a table. Exemplary types of attachments which may be utilized include a pedestal, a pronged ground extension, a stake or a disc attachment.

19 Claims, 6 Drawing Sheets

(56) References Cited

U.S. PATENT DOCUMENTS

| | | | | |
|---|---|---|---|---|
| 5,765,700 | A | 6/1998 | Donne | |
| D397,000 | S | 8/1998 | Goodman | |
| 5,833,080 | A | 11/1998 | Donne | |
| 5,893,469 | A | 4/1999 | Nozawa | |
| D422,140 | S | 4/2000 | Chen | |
| 6,283,566 | B1 | 9/2001 | Doces | |
| 6,460,722 | B2 * | 10/2002 | Lee | 220/592.16 |
| 6,599,482 | B1 | 7/2003 | Dorin | |
| 6,889,945 | B2 | 5/2005 | McCall | |
| D526,170 | S | 8/2006 | Gugni | |
| D559,050 | S | 1/2008 | Mungal | |
| 7,334,908 | B1 * | 2/2008 | Figueroa | 362/101 |
| 7,340,859 | B2 | 3/2008 | Palsrok | |
| D566,480 | S | 4/2008 | Lawler | |
| 7,467,768 | B1 | 12/2008 | Vait | |
| D587,076 | S | 2/2009 | Grady | |
| D618,525 | S | 6/2010 | Garnero | |
| 7,793,793 | B1 | 9/2010 | Sykes | |
| 2005/0051682 | A1 * | 3/2005 | Tuohy et al. | 248/176.1 |
| 2005/0269277 | A1 | 12/2005 | Su | |
| 2006/0037925 | A1 | 2/2006 | Wood | |
| 2006/0261019 | A1 | 11/2006 | Chao | |
| 2008/0173600 | A1 | 7/2008 | Mungal | |
| 2008/0302939 | A1 * | 12/2008 | Su | 248/311.3 |
| 2009/0020667 | A1 | 1/2009 | Johnson | |
| 2009/0258127 | A1 | 10/2009 | Holtz | |
| 2009/0294622 | A1 * | 12/2009 | Medders et al. | 248/523 |

* cited by examiner

WINE GLASS AND BOTTLE HOLDER SUPPORT SYSTEM

CROSS REFERENCE TO RELATED APPLICATIONS

I hereby claim benefit under Title 35, United States Code, Section 120 of U.S. patent application Ser. No. 12/027,681 filed Feb. 7, 2008. This application is a continuation-in-part of the Ser. No. 12/027,681 application. The Ser. No. 12/027,681 application is currently pending. The Ser. No. 12/027,681 application is hereby incorporated by reference into this application.

I hereby claim benefit under Title 35, United States Code, Section 119(e) of U.S. provisional patent application Ser. No. 60/892,487 filed Mar. 1, 2007. The 60/892,487 application is currently abandoned. The 60/892,487 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a wine glass and bottle holder and more specifically it relates to a wine glass and bottle holder support system for displaying, holding and transporting a wine bottle and accompanying glasses in a variety of configurations through the use of different types of attachments.

2. Description of the Related Art

Any discussion of the related art throughout the specification should in no way be considered as an admission that such related art is widely known or forms part of common general knowledge in the field.

Drinking wine requires a user to transport both a bottle and a plurality of wine glasses to a desired location. It can be difficult to transport the wine bottle along with the wine glasses which requires the user to use both hands. In addition, the user can accidentally drop a wine glass during transportation. Further, it can be difficult to safely enjoy the wine in various outdoor locations when a table or other support structure is not readily available.

Because of the inherent problems with the related art, there is a need for a new and improved wine glass and bottle holder support system for displaying, holding and transporting a wine bottle and accompanying glasses in a variety of configurations through the use of different types of attachments.

BRIEF SUMMARY OF THE INVENTION

The invention generally relates to a wine bottle and glass holder which includes an upper support structure including an upper opening, a lower support structure including a lower opening, wherein the lower opening and the upper opening are substantially concentric and including at least one support member connecting the upper support structure to the lower support structure, wherein the support member includes an upper end and a lower end. An attachment member extends from the lower support structure to which various attachments may be secured for allowing support of the wine bottle and glasses in various locations which may not include a steady surface such as a table. Exemplary types of attachments which may be utilized include a pedestal, a pronged ground extension, a stake or a disc support which allows the wine holder to be used as a tabletop.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
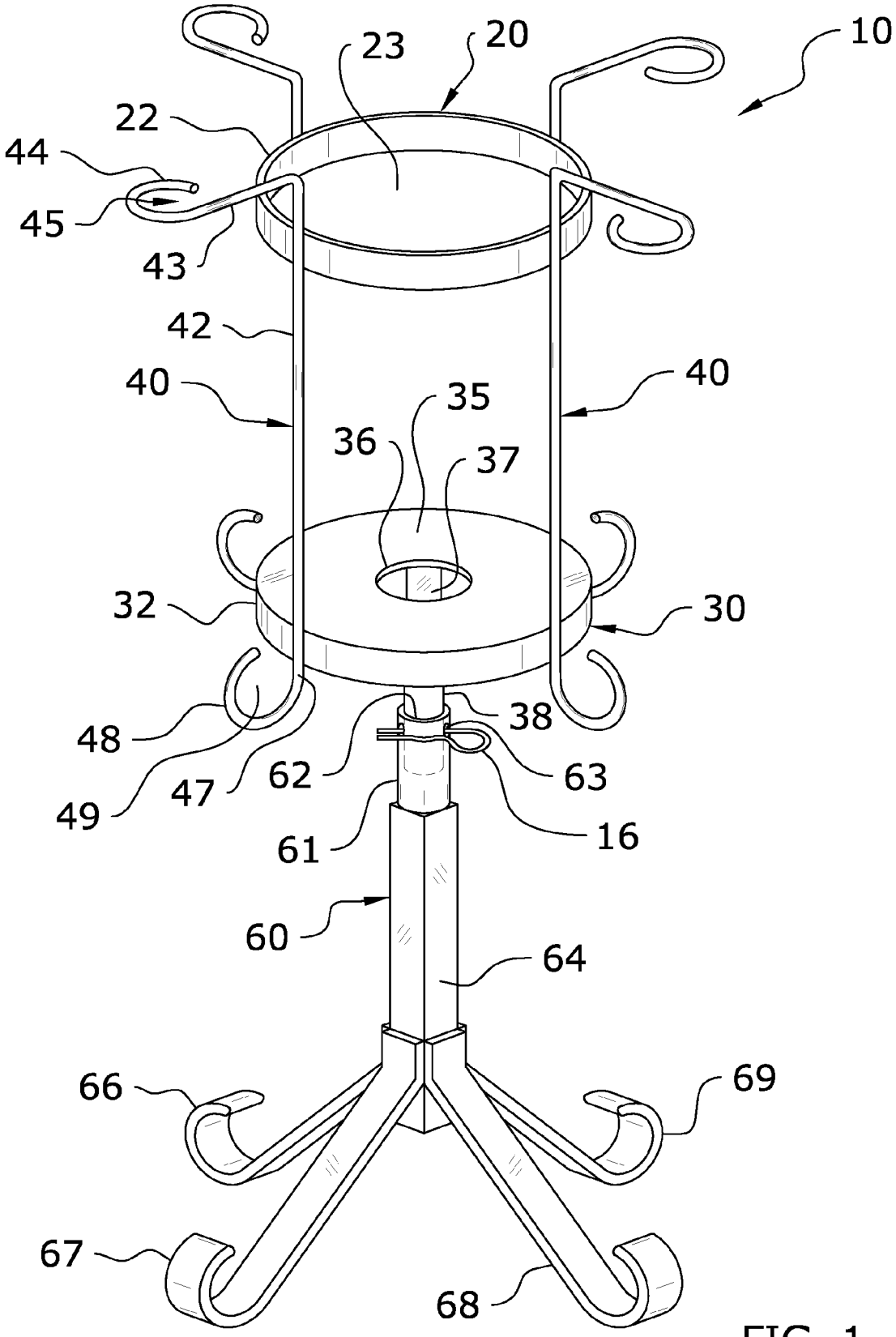
FIG. 1 is an upper perspective view of the present invention with a pedestal attachment secured thereto.

Turning now descriptively to the drawings, in which similar reference characters denote similar elements throughout the several views, FIGS. 1 through 6 illustrate a wine glass and bottle holder system 10, which comprises an upper support structure 20 including an upper opening 23, 25, a lower support structure 30 including a lower opening 36, wherein the lower opening 36 and the upper opening 23, 25 are substantially concentric and including at least one support member 40 connecting the upper support structure 20 to the lower support structure 30, wherein the support member 40 includes an upper end and a lower end. The upper end includes an upper distal portion 44 extending outwardly from the upper support structure 20 and the lower end includes a lower distal portion 48 extending outwardly from the lower support structure 30.

The distal portions 44, 48 are preferably comprised of substantially circular configurations, wherein at least one of the distal portions 44, 48 preferably receives the stem of a wine glass 14 or other container. The opposing distal portion 44, 48 may serves as a base for the present invention or to suspend another wine glass 14 or other container. In the below description of the present invention a wine glass 14 is described as being supported by the present invention; however it is appreciated that the distal portions 44, 48 may be utilized to suspend or support various other merchandise and/or containers rather than a wine glass 14.

The lower support structure 30 will generally include an attachment member 38 extending downwardly therefrom. In a preferred embodiment, the attachment member 38 will extend downwardly from a bracket 37 which is positioned across the lower opening 36 of the lower support structure 30. The attachment member 38 will preferably be comprised of a downward-facing rod to which various attachments 18, 60, 70, 80 may be secured for use of the present invention in various different environments and for different purposes.

The upper opening 23, 25 and the lower opening 36 of the upper support structure 20 and the lower support structure 30 respectively preferably receive a wine bottle 12 or other container to accommodate the wine glasses 14. The wine bottle 12 may be positioned within the upper opening 23, 25 and the lower opening 36 either right side up or upside.

In the below description of the present invention a wine bottle 12 is described as being supported by the present invention; however it is appreciated that the upper opening 23, 25 and the lower opening 36 may collectively receive various other merchandise rather than a wine bottle 12, such as but not limited to flower vases and various other types of bottles 12. It is also appreciated that the present invention may be constructed in various configurations, wherein various displayed configurations may be combined and wherein additional configurations may be utilized to hold more or less bottles 12 and/or glasses 14.

B. Upper Support Structure

Figure 4:
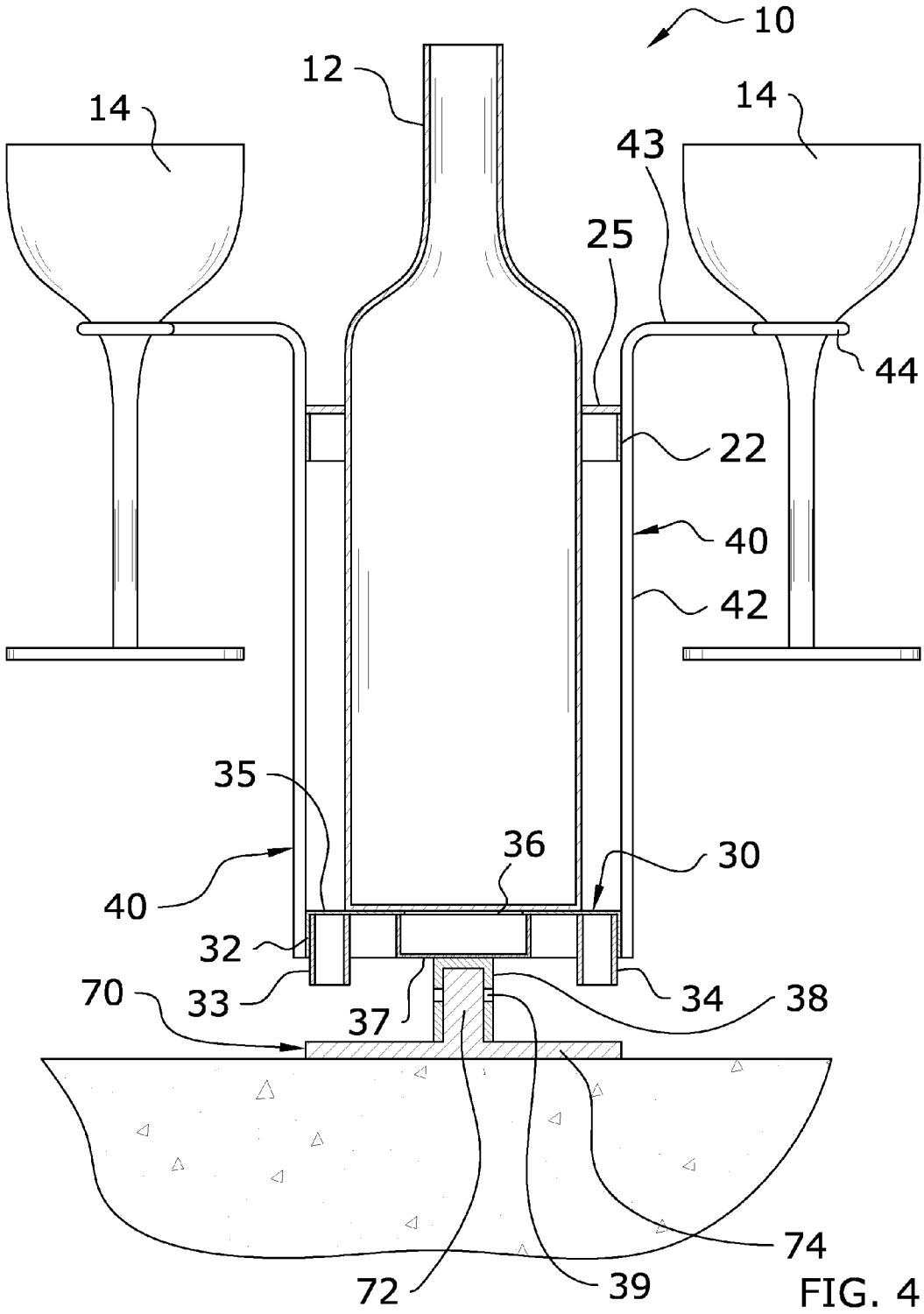
FIG. 4 is a side cutaway view of the present invention with a disc attachment secured thereto.
Figure 5:
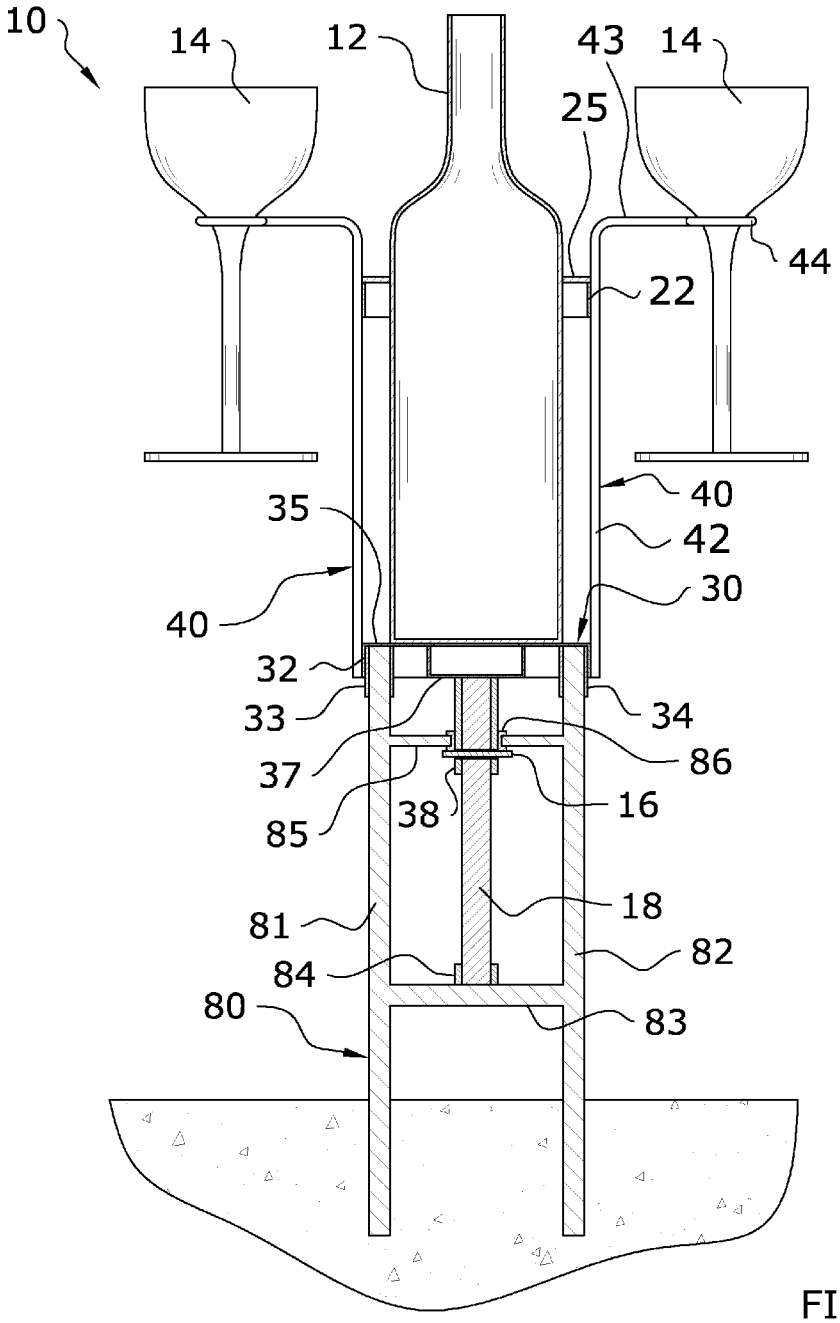
FIG. 5 is a side cutaway view of the present invention with a stand attachment secured thereto.
Figure 6:
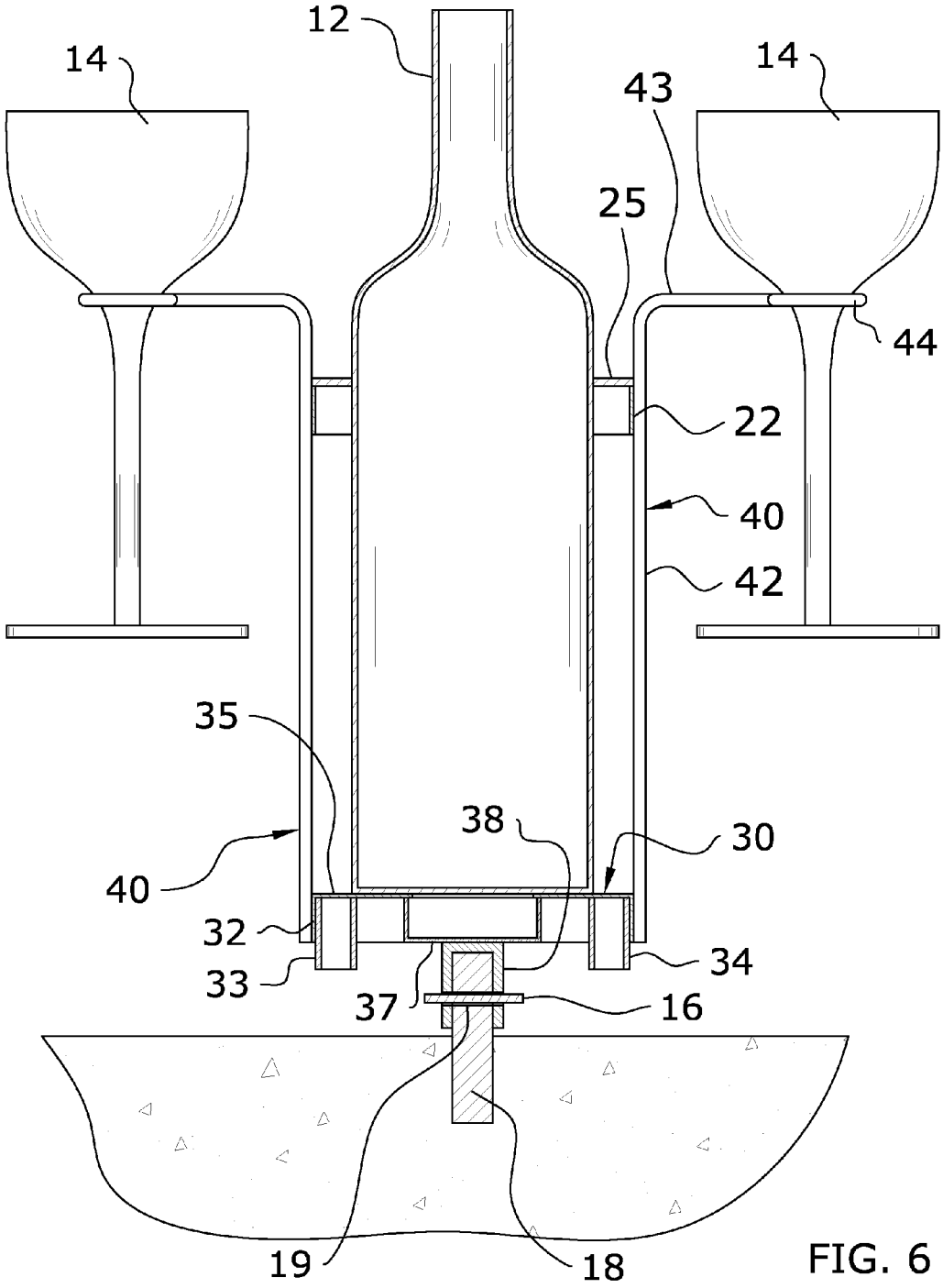
FIG. 6 is a side cutaway view of the present invention with a stake attachment secured thereto.

The upper support structure 20 may be comprised of various shapes, all of which adequately receive a bottle 12 and/or other container as illustrated in FIGS. 4-6. In some configurations of the upper support structure 20 it is appreciated that the upper support structure 20 may receive two or even a plurality of bottles 12. The upper support structure 20 may be comprised of various materials, such as but not limited to metal, wood or plastic. The upper support structure 20 is also preferably positioned substantially above the lower support structure 30 to efficiently stabilize the bottle 12. In the free standing configuration of the present invention the upper support structure 20 is further substantially parallel with the supporting surface (i.e. table top, shelf, etc.) and the lower support structure 30 as illustrated in FIG. 1.

The upper support structure 20 includes an upper ring 22. The upper ring 22 is preferably comprised of a substantially circular shaped configuration. It is appreciated that the upper support structure 20 may include a plurality of upper rings 22 when securing more than one bottle 12 within the present invention. The upper rings 22 include a first upper opening 23. The first upper opening 23 is preferably substantially similar in diameter as the diameter of the bottle 12. The upper ring 22 is further preferably concentric with a majority of the support members 40 as illustrated in FIG. 1.

Figure 2:
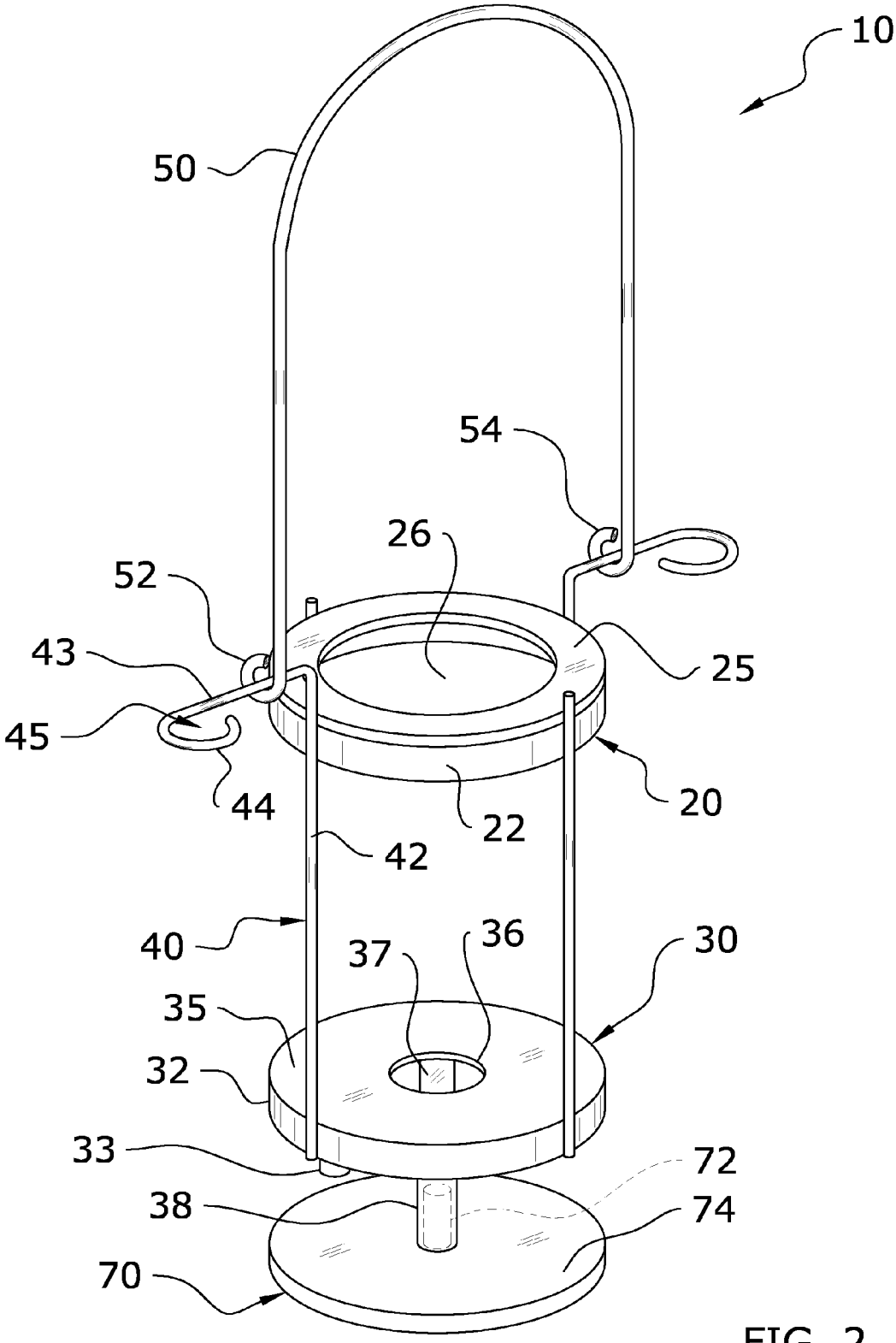
FIG. 2 is an upper perspective view of the present invention with a disc attachment secured thereto.

The upper support structure 20 may also include a spacer member 25. The spacer member 25 is preferably removably positioned upon an upper end of the upper ring 22 as illustrated in FIG. 2. The spacer member 25 is further preferably concentrically positioned upon the upper ring 22. The spacer member 25 includes a second upper opening 26, wherein the second upper opening 26 is concentric with the first upper opening 23. The second upper opening 26 is preferably comprised of a lesser diameter than the first upper opening 23.

The spacer member 25 is preferably utilized when the diameter of the bottle 12 is substantially less than the diameter of the first upper opening 23. The spacer member 25 is generally comprised of a ring-shaped member with an outer diameter which is substantially similar in size than the outer diameter of the upper ring 22 and an inner diameter which is slightly smaller in size than the inner diameter of the upper ring 22.

Figure 3:
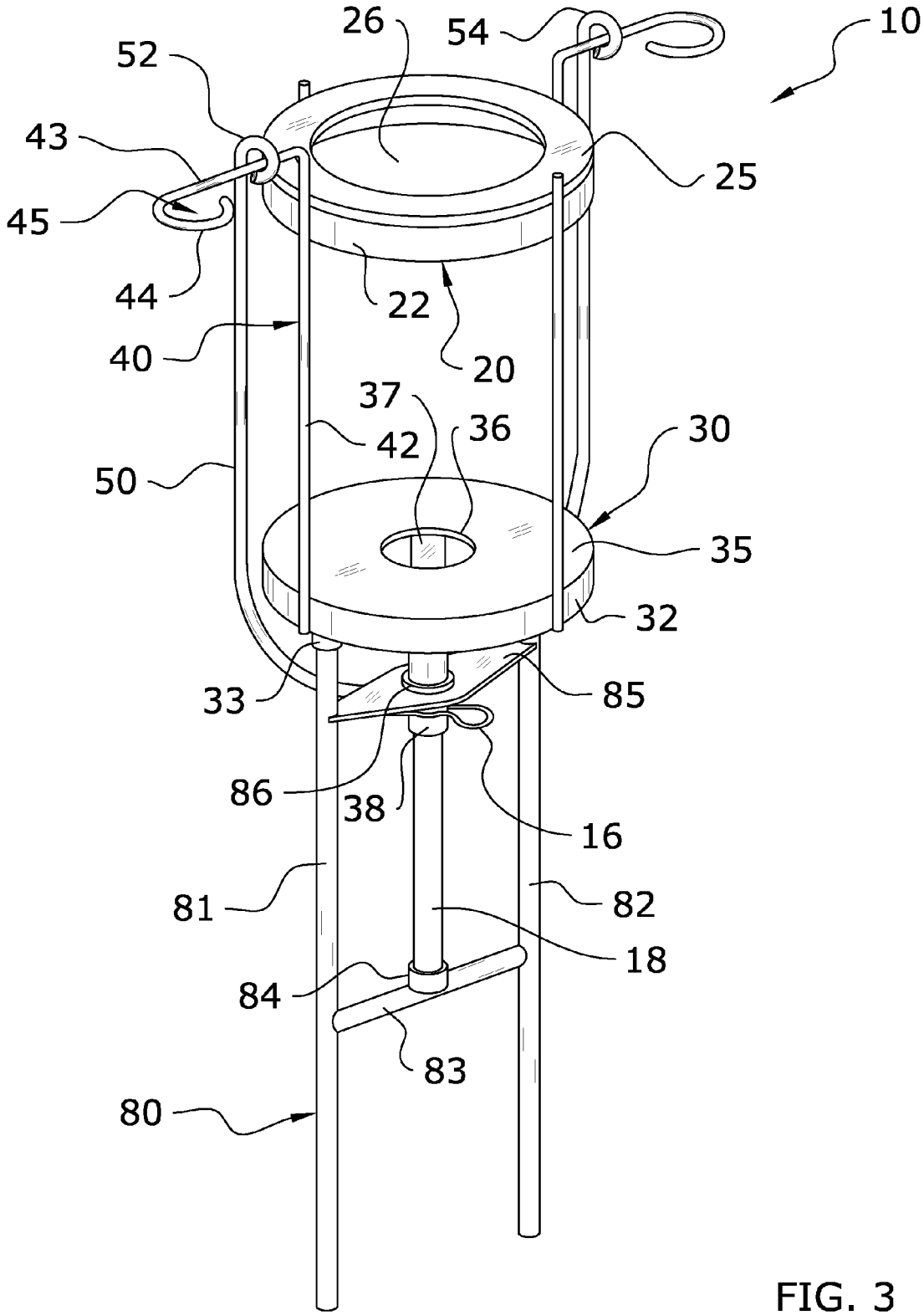
FIG. 3 is an upper perspective view of the present invention with a stand attachment secured thereto.

The spacer member 25 serves to further stabilize the bottle 12 within the upper support structure 20 as illustrated in FIGS. 2 and 3. The spacer member 25 also allows for use of the present invention with different sizes of bottles 12. For example, if a smaller bottle 12 is intended for use with the present invention, a spacer member 25 may be inserted so that the bottle 12 does not wobble within the larger diameter upper ring 22. The spacer member 25 and the upper ring 22 are preferably comprised of separate structures; however it is appreciated that the spacer member 25 and the upper ring 22 may be comprised of an integrally formed structure.

C. Lower Support Structure

The lower support structure 30 may be comprised of various shapes, all of which adequately receive a bottle 12 and/or other container as illustrated in FIGS. 4-6. In some configurations of the lower support structure 30 it is appreciated that the lower support structure 30 may receive two or even a plurality of bottles 12. The lower support structure 30 may be comprised of various materials, such as but not limited to metal, wood or plastic. The lower support structure 30 is further preferably substantially concentric with the upper support structure 20. The outer diameter of the lower support structure 30 is also preferably substantially similar to the outer diameter of the upper support structure 20.

The lower support structure 30 is also preferably positioned substantially below the upper support structure 20 to efficiently stabilize the bottle 12. In the free standing configuration of the present invention, the lower support structure 30 is also preferably positioned substantially close to the supporting surface. In the free standing configuration of the present invention the lower support structure 30 is further substantially parallel with the supporting surface and the upper support structure 20.

The lower support structure 30 includes a lower ring 32. The lower ring 32 serves to stabilize the lower end of the present invention. The lower ring 32 is also preferably comprised of a substantially circular shaped configuration as illustrated in FIG. 1. The lower support structure 30 also includes the lower support member 35. The lower support member 35 is preferably attached to the lower ring 32. The lower support member 35 is further preferably concentrically positioned upon the lower ring 32. The lower support member 35 includes a lower opening 36, wherein the lower opening 36 is concentric with the first upper opening 23 and the second upper opening 26 as illustrated in FIG. 3. The lower opening 36 is preferably comprised of a lesser diameter than the lower ring 32.

The lower ring 32 of the present invention will generally include a pair of receiver members 33, 34 as shown in FIG. 4. Preferably, a first receiver member 33 will be positioned on a first radial end of the lower ring 32 and a second receiver member 34 will be positioned on a second radial end of the lower ring 32, wherein the first and second radial ends are opposite of each other. The receiver members 33, 34 will generally be comprised of downwardly extending brackets or other structures which will act to receive and secure the upper ends of the vertical portions 81, 82 of the stand attachment 80 as best shown in FIG. 5. While the figures illustrate the use of two receiver members 33, 34, it is appreciated that, in some embodiments, more or less receiver members 33, 34 may be utilized to accommodate different types of stand attachments 80.

The lower support member 35 serves to support the base of the bottle 12 when the bottle 12 is oriented upwards. The lower opening 36 of the lower support subsequently serves to receive the neck or cap of the bottle 12 when the bottle 12 is oriented upside down.

The lower support structure 30 also includes a bracket 37 as illustrated in FIG. 4. The bracket 37 is attached to a lower end of the lower support structure 30 and is preferably concentric with the lower opening 36. The bracket 37 is preferably comprised of a U-shaped configuration. The bracket 37 is further positioned between the lower opening 36 and the supporting surface, wherein the bracket 37 supports the cap of the bottle 12 when the neck or cap extends through the lower opening 36.

The lower support structure 30 will also generally include an attachment member 38 extending downwardly from the bracket 37 as shown in FIG. 4. The attachment member 38 will preferably be comprised of a hollow rod or other elongated member which extends in a downward direction from the lower surface of the bracket 37. The attachment member 38 will generally be utilized to secure various attachments 18, 60, 70, 80 to the present invention to allow its use in various environments and for different applications. The attachment member 38 will also preferably include a pair of apertures 38 configured such that a locking member 16 such as a pin may be extended therethrough as shown in FIGS. 4-6. While the figures illustrate an attachment member 38 which is hollow, it is appreciated that various other types of attachment members 38 may be utilized so long as the various attachments 18, 60, 70, 80 of the present invention may be safely secured thereto.

D. Support Member

The present invention preferably includes a plurality of support members 40 extending between the upper support structure 20 and the lower support structure 30 as illustrated in FIG. 1. The support members 40 are also preferably radially spaced around the outer edges of the upper support structure 20 and the lower support structure 30; however it is appreciated that the support members 40 may be positioned about the upper support structure 20 and the lower support structure 30 in various configurations.

The support members 40 will generally serve to both suspend the wine glasses 14 and to provide stability to the present invention as a whole. The support members 40 may also be utilized to extend decorations from. The support members 40 are also preferably substantially perpendicular to the upper support structure 20 and the lower support structure 30.

The support members 40 are preferably comprised of an elongated and cylindrical configuration as illustrated in FIG. 1. The support members 40 are also preferably comprised of a slender configuration. The support members 40 and the present invention are further preferably comprised of an aesthetically pleasing configuration.

The support members 40 may be comprised of various materials, such as but not limited to metal, plastic or wood. The support members 40 are also preferably comprised of a material that is durable and strong, wherein the support members 40 may efficiently support the upper support structure 20 and also stabilize the present invention upon the supporting surface.

The support members 40 include a connecting portion 42. The connecting portion 42 preferably extends from the upper support structure 20 to the lower support structure 30 as shown in FIG. 1. The connecting portion 42 is preferably comprised of a substantially straight structure. The support members 40 also preferably include an upper extending portion 43. The upper extending portion 43 extends from the connecting portion 42 adjacent the upper support structure 20 is preferably an upper extending portion 43. The upper extending portion 43 preferably extends perpendicularly outwardly from the connecting portion 42 and the upper support structure 20.

The upper extending portion 43 is preferably comprised of a length substantially similar or slightly greater than the radius of the wine glass 14 to prevent the wine glass 14 from engaging the bottle 12 when suspended from the support members 40 as illustrated in FIG. 3. The upper extending portion 43 also preferably includes an upper distal portion 44. The upper distal portion 44 extends from the upper extending portion 43 and forms a substantially circular configuration. The stem of the wine glass 14 may be positioned within a first outer opening 45 formed by the upper distal portion 44. The upper distal portion 44 and the first outer opening 45 are preferably substantially parallel to the upper support structure 20 and the lower support structure 30.

In some embodiments of the present invention as shown in FIG. 1, a lower extending portion 47 may also extend from the connecting portion 42 of the support member 40 adjacent the lower support structure 30. The lower extending portion 47 preferably extends perpendicularly outwardly from the connecting portion 42 and the lower support structure 30. The lower extending portion 47 is preferably comprised of a length substantially similar or slightly greater than the radius of the wine glass 14. In a preferred embodiment of the present invention as shown in FIGS. 2-6, the lower extending portion 47 may be omitted.

The lower extending portion 47 also preferably includes a lower distal portion 48. The lower distal portion 48 extends from the lower extending portion 47 and forms a substantially circular configuration as illustrated in FIG. 1. The lower distal portion 48 and the lower outer opening are preferably substantially parallel to the upper support structure 20 and the lower support structure 30.

E. Handle

The present invention may also include a handle 50 to allow for easier mobility of the present invention. The handle 50 may be comprised of various materials, such as but not limited to plastic, metal or wood. The handle 50 is further preferably comprised of a similar material as the support members 40. The handle 50 preferably removably attaches to the upper extending portions 43 of the support members 40 as shown in FIG. 2.

The handle 50 is preferably comprised of an arc-shaped configuration as shown in FIG. 2. The handle 50 also includes a first end 52 and a second end 54, wherein the second end 54 is opposite the first end 52. The first end 52 and the second end 54 are preferably comprised of a U-shaped configuration. The U-shape of the first end 52 of the handle 50 preferably extends in an opposing direction as the U-shape of the second end 54 of the handle 50 to provide a more secure attachment between the handle 50 and the support member 40.

F. Stake Attachment

The present invention will generally include a stake attachment 18 to be used for securing the present invention upright in the ground. As shown in FIG. 6, the stake attachment 18 will generally be comprised of an elongated member which may be secured within the attachment member 38 extending from the bracket 37 of the lower support member 30.

The stake attachment 18 may be comprised of various shapes and sizes, but will preferably be of a slightly smaller diameter than the inner diameter of the cavity of the attachment member 38 to allow the upper end of the stake attachment 18 to fit snugly within the attachment member's 38 hollow inner cavity. It is appreciated that various lengths may be utilized for the stake attachment 18 for various different applications. Further, in some embodiments, the stake attachment 18 may include a pointed lower end to ease its placement into the ground.

As shown in FIG. 6, the stake attachment 18 may include a pair of stake apertures 19 configured such that a locking member 16 such as a pin may be extended therethrough. When installing the stake attachment 18 to the present invention, the upper end of the stake attachment 18 will be inserted within the attachment member 38 and the stake apertures 19 will be aligned with the attachment apertures 39. A locking member 16 such as a pin or other device may then be extended therethrough to secure the stake attachment 18 within the attachment member 38 as shown in FIG. 6. However, it is appreciated that, in some embodiments, a locking member 16 may be omitted.

G. Pedestal Attachment

The present invention will generally include a pedestal attachment 60 as shown in FIG. 1. The pedestal attachment 60 will generally be provided to allow the present invention to freely stand on flat surfaces such as a floor. The pedestal attachment 60 will generally be comprised of a central member 64 comprised of an elongated member having a plurality of legs 66, 67, 68, 69 extending therefrom. The central member 64 of the pedestal attachment 60 may be comprised of various lengths to suit different applications. In some embodiments, the central member 64 may be adjustable in length.

The legs 66, 67, 68, 69 will be utilized to allow the present invention to freely stand upright without wobbling or tipping over. In a preferred embodiment as shown in FIG. 1, a first leg 66, a second leg 67, a third leg 68 and a fourth leg 69 will each extend outwardly from a lower end of the central member 64. However, it is appreciated that more or less legs 66, 67, 68, 69 may be utilized so long as the present invention is capable of securely standing upright when fitted with the pedestal attachment 60.

The upper end of the central member 64 will generally include a receiver member 61 for securing the pedestal attachment 60 to the attachment member 38 of the lower support structure 30. As shown in FIG. 1, the receiver member 61 will generally be comprised of an upwardly-facing, hollow member having an upper opening 62. The diameter of the receiver member 61 will preferably be slightly larger than the diameter of the attachment member 38 such that the receiver member 61 may be secured over and around the attachment member 38.

The receiver member 61 may also include receiver apertures 63 configured such that a locking member 16 such as a pin may be extended therethrough. When installing the pedestal attachment 60 to the present invention, the attachment member 38 of the lower support structure 30 will be inserted within the upper opening 62 of the receiver member 61 and the receiver apertures 63 will be aligned with the attachment apertures 39. A locking member 16 such as a pin or other device may then be extended therethrough to secure the receiver member 61 to the attachment member 38 as shown in FIG. 1. However, it is appreciated that, in some embodiments, a locking member 16 may be omitted.

H. Disc Attachment

The present invention will generally include a disc attachment 70 as shown in FIG. 2. The disc attachment 70 may be utilized to allow the present invention to freely stand on a flat surface such as a floor or the ground. Generally, the disc attachment 70 will be comprised of a base 74 and a connecting member 72.

The base 74 may be comprised of various shapes, but will preferably be comprised of a disc-shaped structure with which the present invention may freely stand without wobbling or tipping over. The connecting member 72 will generally be comprised of an elongated member such as a rod which extends upwardly from the center of the base 74.

Preferably, the connecting member 72 will be comprised of a diameter which is slightly less than the inner diameter of the attachment member 38. To install the disc attachment 70, the attachment member 38 of the lower support structure 30 will be positioned over the connecting member 72 of the disc attachment 70 as shown in FIG. 4.

I. Stand Attachment

The present invention may also include a stand attachment 80 as shown in FIG. 3. The stand attachment 80 will generally be utilized to secure the present invention to various horizontal surfaces to allow access to the bottle 12 and glasses 14 at a chair or similar level.

As shown in FIG. 3, the stand attachment 80 will generally be comprised of a first vertical portion 81, a second vertical portion 82 and a cross member 83 linking the vertical portions 81, 82. The first and second vertical portions 81, 82 will generally extend parallel to each other and the cross member 83 will generally extend perpendicularly with respect to the vertical portions 81, 82. Preferably, the cross member 83 will extend from a position approximately halfway up the length of the vertical portions 81, 82 to provide stability.

The stand attachment 80 will generally include a mount assembly 85 positioned near its upper end to allow connection to the attachment member 38 of the present invention. As shown in FIG. 5, the mount assembly 85 will generally be comprised of a horizontally-extending, substantially flat member which extends from the first vertical portion 81 to the second vertical portion 83 at a position above the cross member 83. The mount assembly 85 will generally include a receiver member 86 comprised of an opening or bracket positioned around the center point of the mount assembly 85 for receiving the attachment member 38 of the lower support structure 30.

In one embodiment, the cross member 83 may include a securing member 84 for receiving a lower end of the stake attachment 18 for storage and to provide additional stability to the present invention. The securing member 84 will generally be comprised of a bracket or other structure which is adapted to receive the lower end of the stake attachment 18 as shown in FIG. 3. The upper end of the stake attachment 18 will generally extend into the lower end of the attachment member 38 or the receiver member 85 of the mount assembly 85.

To install the stand attachment, the lower ends of the vertical portions 81, 83 will generally be inserted into the ground. The upper end of the first vertical portion 81 will be inserted into the first receiver member 33 of the lower support structure 30 and the upper end of the second vertical portion 81 will be inserted into the second receiver member 34 of the lower support structure 30. The attachment member 38 of the lower support structure 30 will be positioned within the receiver member 86 of the mount assembly 85 to secure the stand attachment 80 to the lower support structure 30 as best shown in FIG. 5. Optionally, the stake attachment 18 may be positioned vertically between the cross member 83 and mount assembly 85 as shown in FIG. 5.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A wine glass and bottle holder system, comprising:

a wine bottle;

a plurality of wine glasses;

a lower support structure having a lower ring and a lower support member extending inwardly from said lower ring;

a lower opening centrally extending within said lower support member;

a lower bracket attached to said lower support member and positioned beneath said lower opening;

an attachment member extending downwardly from said lower bracket;

a stand attachment, wherein said stand attachment is adapted to be connected to said attachment member;

a plurality of support members attached to said lower ring and extending upwardly, wherein said plurality of wine glasses are removably supported upon upper portions of said plurality of support members; and an upper support structure attached to said upper portions of said plurality of support members, wherein said upper support structure is comprised of an upper ring defining an upper opening.

2. The wine glass and bottle holder system of claim 1, further comprising a stake attachment, wherein said stake attachment is comprised of an elongated member which is adapted to be connected to said attachment member.

3. The wine glass and bottle holder system of claim 2, wherein said attachment member includes at least one attachment aperture and wherein said stake attachment includes at least one stake aperture.

4. The wine glass and bottle holder system of claim 3, further comprising a locking member which is adapted to be extended through said at least one attachment aperture and said at least one stake aperture to secure said stake attachment to said attachment member.

5. The wine glass and bottle holder system of claim 1, further comprising a pedestal attachment, wherein said pedestal attachment is adapted to be connected to said attachment member.

6. The wine glass and bottle holder system of claim 5, wherein said pedestal attachment is comprised of a central member and a plurality of legs extending outwardly from a lower portion of said central member, wherein said central member is comprised of an elongated member.

7. The wine glass and bottle holder system of claim 6, wherein said central member includes a receiver member positioned adjacent its upper end and wherein said receiver member includes an upper opening.

8. The wine glass and bottle holder system of claim 7, wherein said attachment member is adapted to be positioned within said receiver member.

9. The wine glass and bottle holder system of claim 8, wherein said receiver member includes at least one receiver aperture and wherein said attachment member includes at least one attachment aperture.

10. The wine glass and bottle holder system of claim 9, further comprising a locking member which is adapted to be extended through said at least one attachment aperture and said at least one receiver aperture to secure said pedestal attachment to said attachment member.

11. The wine glass and bottle holder system of claim 1, further comprising a disc attachment, wherein said disc attachment is adapted to be connected to said attachment member.

12. The wine glass and bottle holder system of claim 11, wherein said disc attachment is comprised of a circular base and a connecting member.

13. The wine glass and bottle holder system of claim 12, wherein said attachment member is hollow and wherein said connecting member is adapted to be positioned within said attachment member to secure said disc attachment to said attachment member.

14. The wine glass and bottle holder system of claim 1, wherein said stand attachment is comprised of a first vertical portion, a second vertical portion and a cross member.

15. The wine glass and bottle holder system of claim 14, wherein said lower ring includes a first receiver member and a second receiver member, wherein an upper end of said first vertical portion is adapted to be positioned within said first receiver member and an upper end of said second vertical portion is adapted to be positioned within said second receiver member.

16. The wine glass and bottle holder system of claim 15, wherein said stand attachment includes a mount assembly, wherein said mount assembly includes a receiver member, wherein said attachment member is adapted to be positioned within said receiver member.

17. The wine glass and bottle holder system of claim 16, wherein a lower end of said first vertical portion and a lower end of said second vertical portion are adapted to be driven into a surface.

18. A wine glass and bottle holder system, comprising:

a wine bottle;

a plurality of wine glasses;

a lower support structure having a lower ring and a lower support member extending inwardly from said lower ring;

a lower opening centrally extending within said lower support member, wherein said lower opening has a size slightly larger than a neck of said wine bottle and receives said neck of said wine bottle;

a lower bracket attached to said lower support member and positioned beneath said lower opening to support a distal end of said neck of said wine bottle;

an attachment member extending downwardly from said lower bracket, wherein said attachment member is hollow;

a plurality of support members attached to said lower ring and extending upwardly, wherein said plurality of wine glasses are removably supported upon upper portions of said plurality of support members;

an upper support structure attached to an upper portion of said plurality of support members, wherein said upper support structure is comprised of an upper ring defining an upper opening, wherein said upper opening has a size slightly larger than a base of said wine bottle; and a stake attachment, wherein said stake attachment is comprised of an elongated member which is adapted to be connected to said attachment member, wherein an upper end of said stake attachment is positioned within said attachment member and a lower end of said stake attachment is adapted to be driven into a surface.

19. A wine glass and bottle holder system, comprising:

a wine bottle;

a plurality of wine glasses;

a lower support structure having a lower ring and a lower support member extending inwardly from said lower ring;

a lower opening centrally extending within said lower support member, wherein said lower opening has a size slightly larger than a neck of said wine bottle and receives said neck of said wine bottle;

a lower bracket attached to said lower support member and positioned beneath said lower opening to support a distal end of said neck of said wine bottle;

an attachment member extending downwardly from said lower bracket, wherein said attachment member is hollow;

a plurality of support members attached to said lower ring and extending upwardly, wherein said plurality of wine glasses are removably supported upon upper portions of said plurality of support members;

an upper support structure attached to an upper portion of said plurality of support members, wherein said upper support structure is comprised of an upper ring defining an upper opening, wherein said upper opening has a size slightly larger than a base of said wine bottle;

a pedestal attachment, wherein said pedestal attachment is adapted to be connected to said attachment member, wherein said pedestal attachment is comprised of a central member and a plurality of legs extending outwardly from a lower portion of said central member, wherein said central member is comprised of an elongated member;

wherein said central member includes a receiver member positioned adjacent its upper end and wherein said receiver member includes an upper opening, wherein said attachment member is adapted to be positioned within said receiver member, wherein said receiver member includes at least one receiver aperture and wherein said attachment member includes at least one attachment aperture; and a locking member which is adapted to be extended through said at least one attachment aperture and said at least one receiver aperture to secure said pedestal attachment to said attachment member.

* * * * *